US005255416A

United States Patent [19]

Eichenberger et al.

[11] Patent Number: 5,255,416

[45] Date of Patent: Oct. 26, 1993

[54] COMBING MACHINE WITH MEANS FOR LIMITING MOVEMENT OF TOP NIPPER

[75] Inventors: Hans-Ulrich Eichenberger; Giancarlo Mondini; Heinz Clement, all of Winterthur; Walter Ackeret, Seuzach, all of Switzerland

[73] Assignee: Rieter Machine Works, Ltd., Winterthur, Switzerland

[21] Appl. No.: 675,427

[22] Filed: Mar. 26, 1991

[30] Foreign Application Priority Data

Apr. 14, 1990 [CH] Switzerland ..... 01273/90

[51] Int. Cl.[5] ..... D01G 19/16

[52] U.S. Cl. ..... 19/228; 19/225

[58] Field of Search ..... 19/215, 216, 217, 223, 19/225, 227, 228, 233, 234, 235

[56] References Cited

U.S. PATENT DOCUMENTS

| | | | |
|---|---|---|---|
| 724,119 | 3/1903 | Nasmith | 19/223 |
| 1,826,494 | 10/1931 | Barker | 19/225 |
| 2,005,001 | 6/1935 | Nasmith | 19/227 |
| 2,680,885 | 6/1954 | Schleifer | 19/228 |
| 3,066,360 | 12/1962 | Naegeli | 19/227 |
| 3,108,333 | 10/1963 | Schleifer | 19/228 |
| 3,400,431 | 9/1968 | Strzelewicz, Jr. | 19/215 |

FOREIGN PATENT DOCUMENTS

| | | |
|---|---|---|
| 0210764 | 2/1987 | European Pat. Off. . |
| 1241591 | 8/1960 | France . |
| 2034779 | 6/1980 | United Kingdom . |

*Primary Examiner*—Clifford D. Crowder
*Assistant Examiner*—Michael A. Neas
*Attorney, Agent, or Firm*—Francis C. Hand

[57] ABSTRACT

The combing machine as provided with a nipper jaw unit in which a nipper lip is provided on the top nipper plate to project in overlapping relation to the lower nipper plate for clamping a wadding therebetween. In a fully closed position of the nipper plates, with the nipper plates in contact, the nipper lip projects into the plane of the needles of the combing segment of the combed cylinder. However, the combed segment is provided with raised bearing segments to lift the nipper lip away from the needles over a safety clearance. In other embodiments, stops can be provided on the lower nipper to limit the movement of the top nipper towards the closed position.

6 Claims, 7 Drawing Sheets 2
3
4
5
6
7
8
9
10
13
14
15
19
20
21
22
23
29
35
36
37
38
39
A
N

COMBING MACHINE WITH MEANS FOR LIMITING MOVEMENT OF TOP NIPPER

This invention relates to a combing machine. More particularly, this invention relates to a combing machine and a nipper jaw unit for a combing machine.

As is known, various types of combing machines have been employed for the combing of a textile wadding. For example, one known type of combing machine employs a nipper unit having a lower nipper which can be reciprocated back and forth relative to a combing cylinder and a top nipper which is pivotally mounted and connected with the lower nipper so as to move between an open position and a closed position relative to the lower nipper. When in the open position, a wadding can be fed between the two nippers whereas in the closed position, the two nippers grasp a leading end of the wadding so that a combing action can be performed by the comb cylinder.

In order to increase productivity, increasingly heavier weights of Wadding have been supplied to the combing machines. As a consequence, the thickness of the wadding conveyed to the nipper jaw unit varies. As a result, the two clapping surfaces of the nippers are positioned considerably further away from each other during the clamping of a thicker wadding than would be the case With the usual wadding thickness. Accordingly, a wider clamping gap is formed.

For combing out the wadding by means of a circular comb, the nipper unit is closed in order to clamp the wadding whereby a part of the free end of the wadding projects out of the nipper for combing out by the circular comb. This projecting part is generally known as a fiber tuft.

In order to achieve a maximum clamping effect through the circular comb, with which the short fibers and other undesirable components, such as neps, husk fragments or similar, are combed out of the fiber tuft, the fiber tuft should be grasped and combed out as completely as possible by a combing segment on the circular comb or by needles on the combing segment.

In order to attain this, in practice, the top nipper, or a nipper plate thereon, is provided with a nipper lip arranged in the area of the clamping position in a radial direction to the axis of the circular comb, so as to overlap by a front face of the lower nipper or a nipper plate thereon. Through this, the wadding or the fiber tuft is arranged approximately in the radial direction of the comb axis before being laid in front of the comb segment.

In order to prevent yielding of the fiber tuft from the comb segment after grasping by the comb segment, the lower edge of the nipper lip must be brought as near as possible to the casing circle (i.e. imaginary cylinder) of the comb segment.

This, however is not possible with conventional nippers, as especially with thick wadding, the clearance between the clamping surfaces of the top and lower nippers is increased and through this, the clearance between the lower edge of the nipper lip and the casing circle of the comb segment is also increased. The result is that a part of the fiber tuft can move out of the grasping area of the comb segment and not be completely combed out.

The requirement also exists, with interrupted wadding feed, that is, when no further wadding is to be found in the clamping position, that swinging out of the nipper lip into the working area of the comb segment must be prevented at all events. This is necessary in order to avoid damage to the nipper lip or the comb segment. With the conventional nipper jaw units, the nipper is therefore formed in the area of the clamping position in such a way that, with the direct laying of the two clamping surfaces, one on top of the other, a safety clearance is still available between the lower edge of the nipper lip and the casing circle of the comb segment.

If this nipper would be used for combing out thick wadding, then, with the fall out of the wadding, the safety clearance to the casing circle of the comb segment would indeed be given. However, for optimum combing out, as a result of the wider spacing between the two combing surfaces, the lower edge of the nipper lip would have a spacing to the casing circle of the comb segment which is too wide. This means, the fiber tuft can yield outwards from the comb segment during the combing out.

Accordingly, it is an object of the invention to form the clamping position of a nipper jaw unit in such a way that an optimum combing out of a positioned fiber tuft of a thick wadding is made possible.

It is another object of the invention to provide a nipper jaw unit of relatively simple construction which can be adapted to combing relatively thick waddings.

It is another object of the invention to increase the productivity of a combing machine.

Briefly, the invention provides a combing machine which includes a circular comb and a nipper jaw unit. The circuit comb is rotatably mounted on an axis of rotation and has a comb segment thereon with a plurality of projecting combing elements extending within an imaginary cylinder having a constant radius from the axis of rotation.

The nipper jaw unit is provided to hold a leading end of a wadding in place for combing by the combing elements. This unit includes a lower nipper, a top nipper for moving relative to the lower nipper between an open position spaced from the lower nipper and a closed position in contact with the lower nipper and a nipper lip on the top nipper which is disposed in overlapping relation with the lower nipper when the top nipper is in the closed position. The nipper lip is also spaced from the axis of rotation of the comb a distance less than the radius of the imaginary cylinder. In this respect, the closed position means that the two nippers are in contact.

In addition, a means is provided for limiting movement of the top nipper towards the closed position on the lower nipper in order to provide a safety clearance between the nipper lip and the imaginary cylinder of the combed segment. In this way, swinging out of the nipper lip is avoided With larger fluctuations in the thickness of the wadding in the working area of the comb segment, or, for example, when the wadding is missing.

Through this limitation of the field of traverse of the top nipper, the nipper lip can be extended for combing out thick wadding so far that the same optimum relationship exists for combing out as with the hitherto conventional wadding thickness with the usual combing machines. This means, during the combing operation, the nipper lip can be moved to a minimum clearance to the imaginary cylinder of the comb segment, without damage resulting to the comb segment or to the nipper lip with a fall-out of the wadding, or with the erroneous use of wadding with low wadding weight.

In one embodiment, the means for limiting the movement of the top nipper may employ at least one spacer segment secured to the comb segment and which projects radially through the imaginary cylinder of the combing elements. Alternatively, the spacer segment may be fitted in the area of the comb segment. Such a segment is fastened so as to project into the field of traverse of the nipper lip so that further pivoting of the nipper lip into the imaginary cylinder of the comb segment is prevented. Such a segment may be made of non-metallic material. However, a combination of metallic and non-metallic materials, for instance, a metallic material with a wear-resisting coating with low friction may be used. As a non-metallic material, the use of plastic, fiber reinforced material or similar could be considered. Aluminum could also be used as a material for the segments. The segments should have a wear resisting surface in all cases, so that the safety clearance is always ensured. However, if signs of wear appear, an exchange is possible at any time because of the detachable fastening of the segments.

In another embodiment, the means for limiting the field of traverse of the top nipper is in the form of a stop mounted on the lower nipper, which projects into the field of traverse of the top nipper or against an end stop fastened in the field of traverse of the top nipper. For the exact setting of the safety clearance between the imaginary cylinder of the combing segment and the nipper lip, the stop is formed to be adjustable.

Furthermore, this adjustable stop may be wedge shaped. Through this, an exact close adjustment of the safety clearance is possible.

In still another embodiment, the means for limiting the movement of the top nipper may be in the form of a rod pivotally mounted on the rotation axis of the circular comb and connected with an alterable clearance with the top nipper up to a predetermined safety clearance. Preferably, the rod is formed to be adjustable, in order to be able to adjust the safety clearance between the nipper lip and the imaginary cylinder of the comb segment.

In another embodiment, the nipper lip may be adjustably mounted on the top nipper relative to the lower nipper. In this respect, the nipper lip may be in the form of a plate which is adjustably mounted on the top nipper so that the nipper lip can be adjusted relative to a clamping surface of a nipper plate on the top nipper. This permits an adjustment of the wadding to be combed out. In this respect, the clamping surface of the nipper plate is that surface which runs in the direction of the feed direction of the wadding fed to the clamping position of the nipper as viewed approximately in the clamping position of the nipper unit.

In order to carry out an adjustment, the lower edge of the nipper may be moved towards or away from the circular comb segment.

Alternatively, the nipper lip may include a movable part thereon which is mounted for movement relative to the lower nipper.

In order to achieve the same effect, the clamping surface of the top nipper plate may also be mounted in an adjustable fashion.

In each of the above embodiments, an optimal minimum clearance should be ensured between the nipper lip and the imaginary cylinder of the comb segment when combing out a clamped wadding. By adjusting the pivoting action of the lower nipper plate of the lower nipper in the area of the clamping position, the nipper unit may be set so that for normal operation, a swinging out of the nipper lip into the comb segment is prevented.

These and other objects and advantage of the invention will become more apparent from the following detailed description taken in conjunction with the accompanying drawings wherein.

Figure 1:
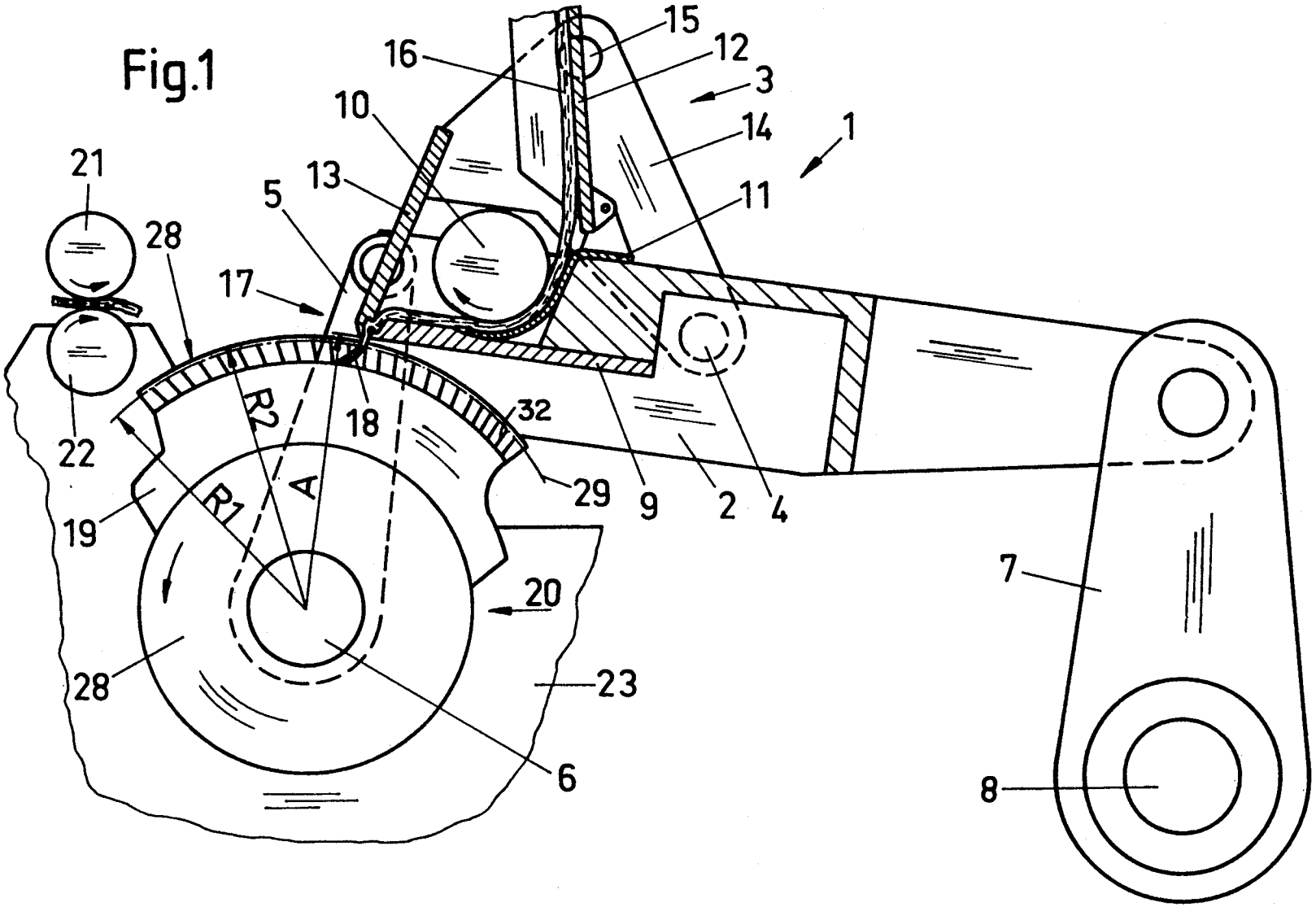
FIG. 1 illustrates a schematic side view of a nipper jaw unit and of a circular comb of a combing machine constructed in accordance with the invention.

Referring to FIG. 1, the combing machine has a nipper jaw unit 1 having a lower nipper 2 and a top nipper 3 pivotally mounted on the lower nipper 2 by means of a pivot pin 4. As indicated, the lower nipper 2 is supported in a frontal area on nipper arms 5 on both sides of an axle 6 of a circular comb 20, and is supported to swivel on a carrying arm 7 in a rear area via a driving shaft 8. The lower nipper 2 carries a nipper plate 9, a rotatable feed roller 10 above the nipper plate 9, and a guide plate 11 fitted with a radial clearance to the periphery of the feed roller 10. Above and as an extension of the guide plate 11, a further guide plate 12 is fitted to swivel on the lower nipper 2.

The top nipper 3 is provided with a nipper plate 13, which is fastened between two lateral carrying arms 14, which are arranged to swivel on the pivot pin 4. This arrangement can be seen from FIG. 2. The two lateral carrying arms 14 of the top nipper 3 are connected via a pivot pin 15 and a rod combing head.

During operation, with an intermittent drive via the driving shaft 8, the nipper 1 alternates between a rear and a forward position in a conventional manner. Through the appropriate pivoting of the top nipper 3 on the pivot pin 15, the top nipper 3 moves between a closed position and an open position during the reciprocating movement of the top nipper.

In the embodiment shown in FIG. 1, the nipper 1 is in a rear and closed position. In this position, a wadding 16 fed from a lap, (not shown), is clamped in the nipper 1. The free end of the wadding, also known as a fiber tuft 18, projecting over a clamping position 17, is thereby combed out by a comb segment 19 of the circular comb 20. In a forward position of the nipper 1, (not shown), the plates 9, 13 take up an open position, whereby the combed out fiber tuft 18 is grasped and torn off the wadding 16 by two detaching rollers 21, 22. The detaching rollers 21, 22, then rotate in the opposite direction to the direction of rotation, which is shown by arrows in FIG. 1.

The direction of rotation shown in FIG. 1 of the detaching rollers 21, 22 is intended for the partial return of the fiber tuft which has already been torn off or for the attachment or agglutination of the following fiber tuft 18 to be torn off.

The detaching rollers 21, 22, the circular comb 20 as well as the driving shaft 8 are supported in a roughly indicated machine frame 23. The feed roller 10 is driven intermittently through the reciprocation of the nipper 1 and therewith feeds the wadding 16 in steps from the clamping position 17 to the nipper 1.

As illustrated, the comb segment 19 is provided with a plurality of projecting combing elements in the form of needles 32 which extend within an imaginary cylinder (casing circle) 29 having a constant radius R1 from the axis of rotation of the circular comb axle 6.

Figure 3:
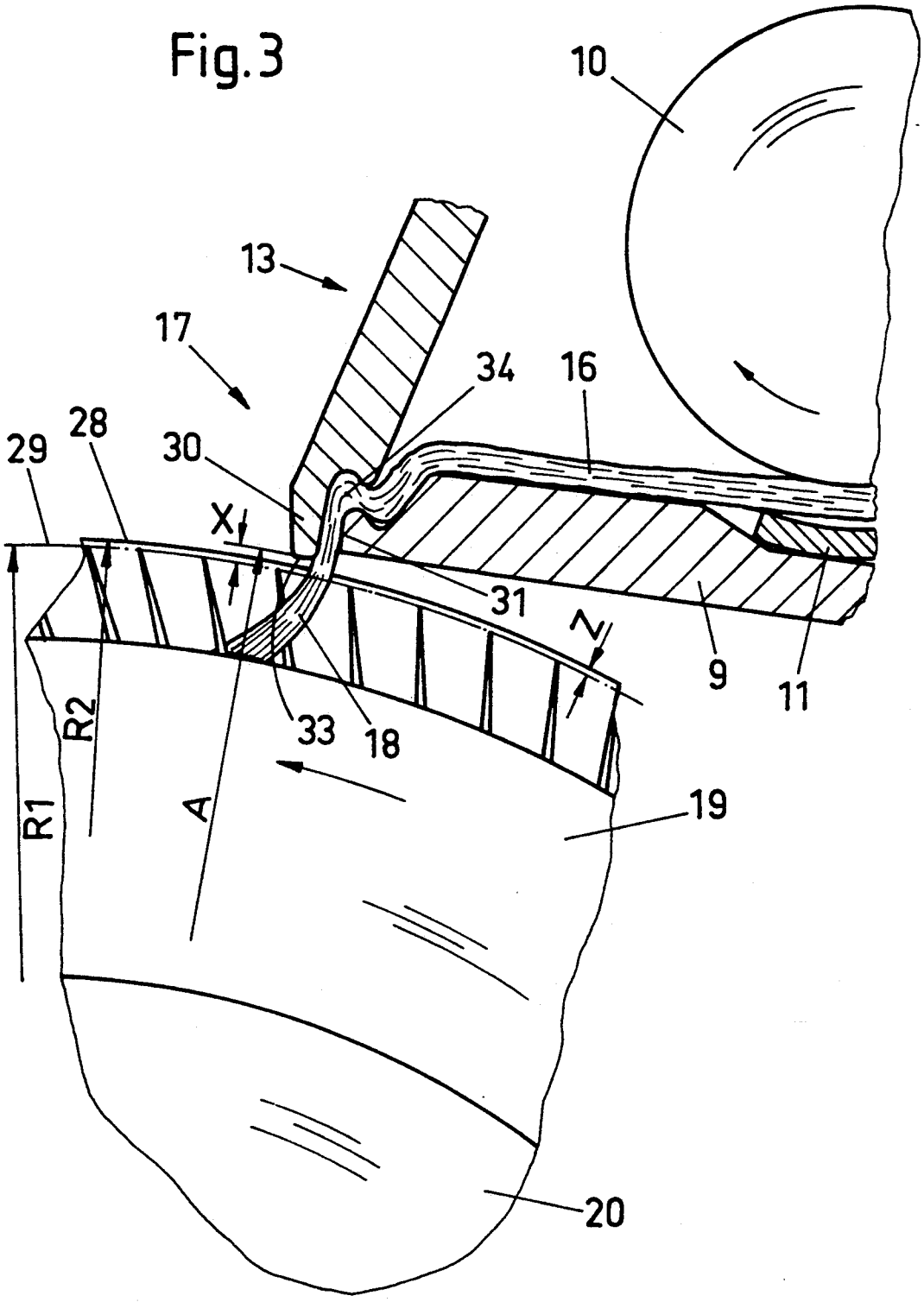
FIG. 3 illustrates an enlarged view of the clamping position of the nipper jaw unit of FIG. 1.

An enlarged representation of the clamping position 17 of the nipper 1 is shown in FIG. 3. As shown, the nipper plates 13, in the frontal area of the clamping position 17 are provided respectively with an isolated clamping profile. Thereby, the top nipper plate 13 has a nipper lip 30 which overlaps a front face 31 of the lower nipper plate 9 and which projects beyond the lower nip plate 9 particularly in the closed position in which the nipper plates 9, 13 are in contact. Through this, the fiber tuft 18 is placed for combing out in a nearly radial direction to the axis of the circular comb 20. On the basis of the direction of movement of the circular comb 20 during the combing operation of the fiber tuft 18, after grasping by the comb segment 19, the comb segment 19 is rotated in the direction of tearing of the detaching rollers 21, 22.

So that the fiber tuft 18 can be grasped as completely as possible by the comb needles 32, yielding of the fiber tuft 18 out in the area of the comb needles 32 during the combing operation should be avoided. To this end, the underneath edge 33 of the nipper lip 30 is brought as close as possible with a minimum clearance X to the imaginary cylinder 29 of the comb segment 19 during the combing operation. Through the corresponding thickness of the Wadding 16, a correspondingly large clamping gap 34 is available in the clamping position. This clamping gap 34 seen in the direction of the axis of the circular comb 6, is larger in a radial direction than the minimum clearance X.

Figure 2:
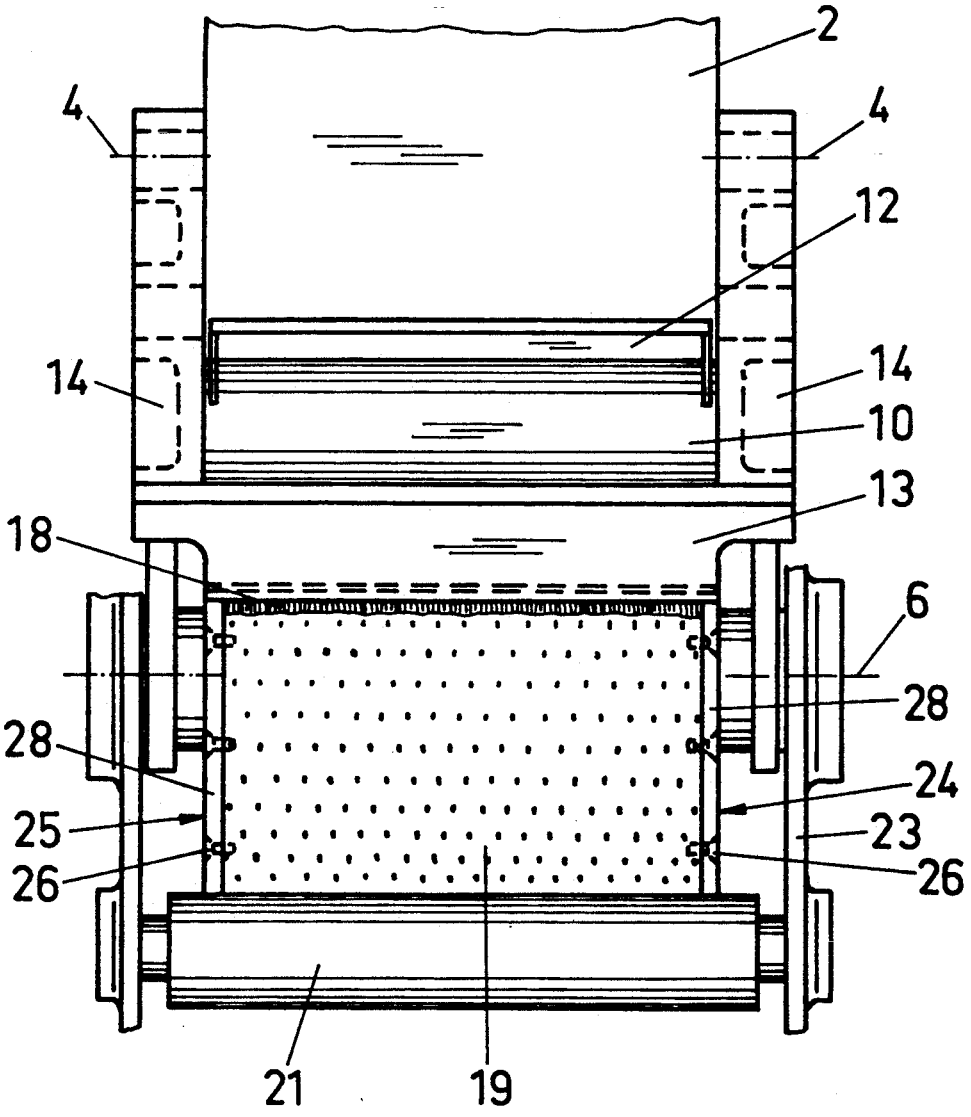
FIG. 2 illustrates a top view of the nipper jaw unit and circular comb of FIG. 1.

In order to provide for the formation of the clearance X, a means is provided for limiting movement of the top nipper 3 towards the closed position on the lower nipper 2. For example, as indicated in FIG. 2, a pair of spacer segments, 24, 25 are fastened on opposite sides of the comb segment 19 in the area of the front face of the comb segment 19 by means of screws 26. The segments 24, 25 may also be glued or fastened in some other way. In any event, the segments 24, 25 are secured in place so that they are detachable in the event of wear. As indicated in FIG. 3, each segment 24, 25 projects radially through the imaginary cylinder 29 so as to have a banking or bearing surface 28 on a radius R2 greater than the radius R1 of the imaginary cylinder 29.

With an interruption of the wadding feed, or with the erroneous processing of a wadding with less wadding weight, the nipper lip 30 would reach the area of the comb needles 32 without the two segments 24, 25 being in place and this would lead to severe damage. In the embodiment shown, however the swivelling movement of the top nipper plate 13 is limited through the positioning of the lower edge 33 of the nipper lip 30 on the banking face 28 of the segments 24, 25. This means that a safety clearance Z is ensured between the imaginary cylinder 29 of the comb segment 19 and the bearing face 28 of the segments 24, 25, even though a free clamping space is still available in the area of the clamping position 17 which would permit further swivelling. The safety clearance Z is formed from the difference between the radius R2 of the bearing surface 28 and the radius R1 of the imaginary cylinder 29 of the comb needle points 32 and is advantageous set between 0.2 and 0.4 millimeters.

Figures 4, 5:
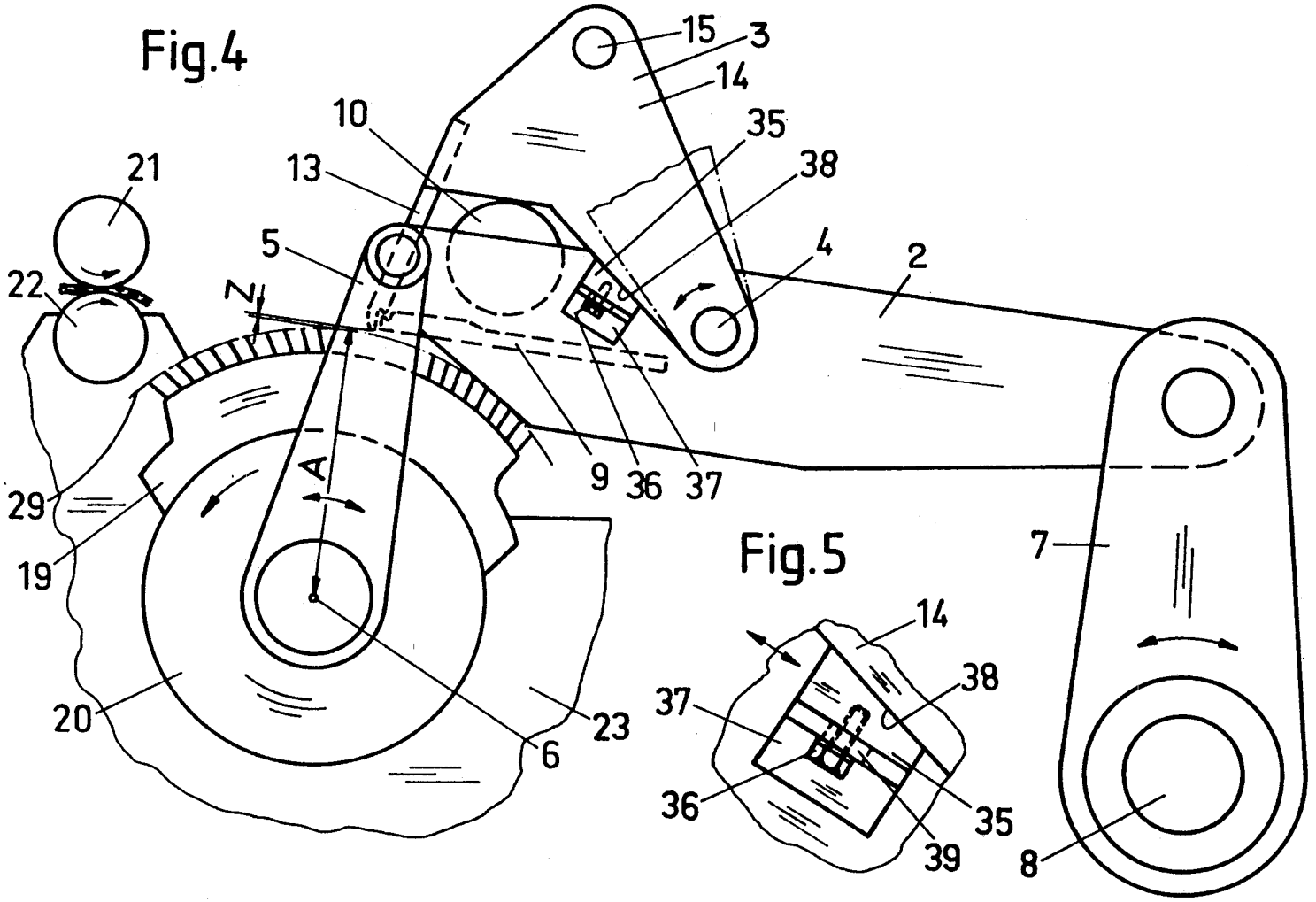
FIG. 4 illustrates a modified nipper unit having an adjustable stop for limiting movement of a top nipper in accordance with the invention.
FIG. 5 illustrates an enlarged view of the stop of FIG. 4.

Referring to FIG. 4, wherein like reference characters indicate like parts as above, the means for limiting the movement of the top nipper plate 13 towards the closed position may be in the form of a pair of stops 35 mounted on the lower nipper 2 for engaging with the arms 14 or the top nipper 3. As indicated in FIG. 5, each stop 35 is wedge shaped and adjustably mounted via a screw 36 to a bracket 37 fitted on the lower nipper 2. The bracket 37 is provided with an oblong opening 39 for the lateral displacement of the stop 35 as indicated by the double arrow so as to adjust the stop position of the carrier arm 14 relative to a bearing surface 38 of the stop 35. Thus, by laterally displacing of setting of the stop 35, the safety clearance Z can be set precisely with the aid of a feeler gauge slid between the needle points 32 and the lower edge 33 of the nipper lip 30. In this embodiment, no wear results on the nipper lip 30 or the stop 35.

Figure 6:
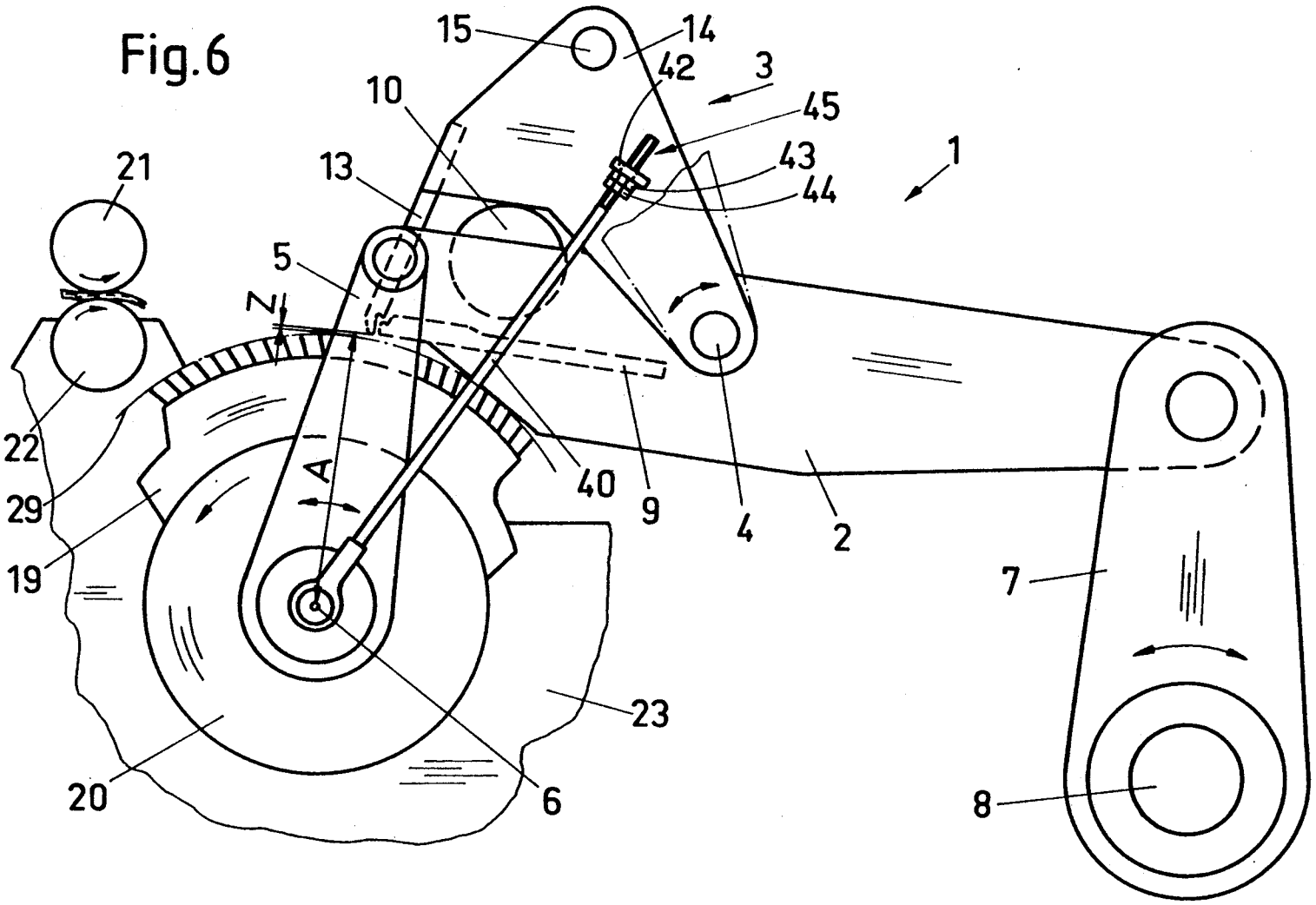
FIG. 6 illustrates a further modified arrangement for limiting the movement of a top nipper in accordance with the invention.

Referring to FIG. 6, wherein like reference characters indicate like parts as above, the means for limiting the movement of the top nipper 3 may be in the form of a rod 40 which is pivotally mounted at one end on the axis of the comb axle 6 while being secured at the opposite end to the top nipper for relative movement thereto. In this respect, the rod 40 projects through an opening 41 in a bracket 42 which is secured to a respective lateral arm 14 of the top nipper 3. The free end of the rod 40 projecting through the bracket 42 is provided with a screw thread 45 which carries a nut 43 and a lock nut 44 below the bracket 42. After slackening the lock nut 44 the safety clearance Z is adjusted through the nut 43 with the aid of a feeler gauge which is slid between the nipper lip 30 and the comb segment 19. When this has been carried out, the nut 43 is fastened by the lock nut 44 in the set position.

There are still further possible embodiments for the limitation of the movement of the top nipper 3 for the maintenance for the safety clearance Z. Further, the nipper jaw unit may be one which executes reciprocating movements or one which has a different kinematic working method.

Figure 7:
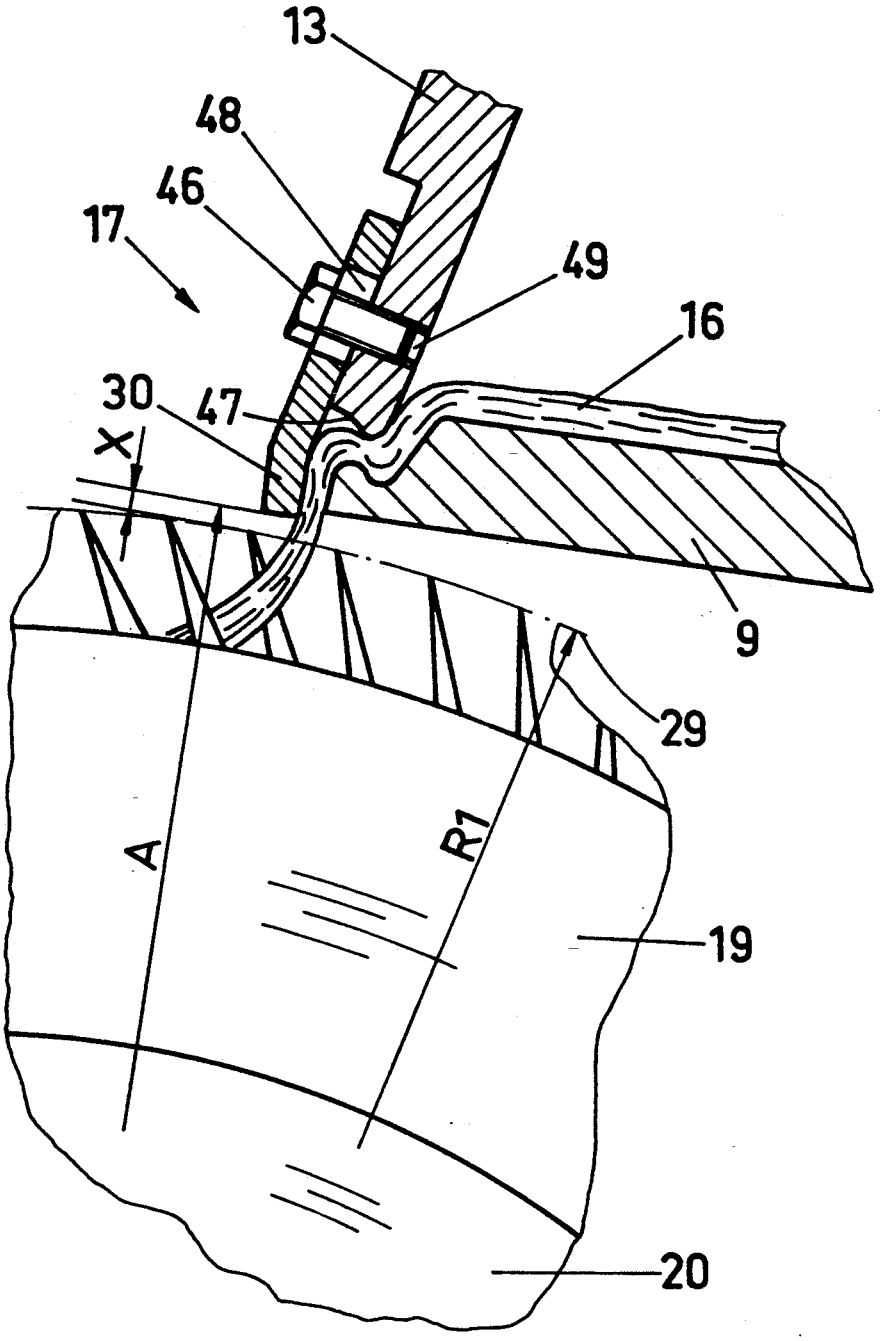
FIG. 7 illustrates an enlarged view of an adjustably mounted nipper plate in accordance with the invention.

Referring to FIG. 7, wherein like reference characters indicate like parts as above, a nipper lip 30 in the form of a plate may be adjustably mounted at the bottom of the top nipper plate 13. As indicated, the nipper lip plate 30 is secured to the top nipper plate 13 by means of a screw 46 which passes through an enlarged opening 48 in the nipper lip plate 30 and is threaded into a threaded bore 49 in the top nipper plate 13. This means that the clearance to a top clamping surface 47 of the top nipper plate 13 can be adjusted depending upon the thickness of the wadding so that the nipper jaw unit 1 can be used universally, that is, for thick and normal waddings.

Figure 8:
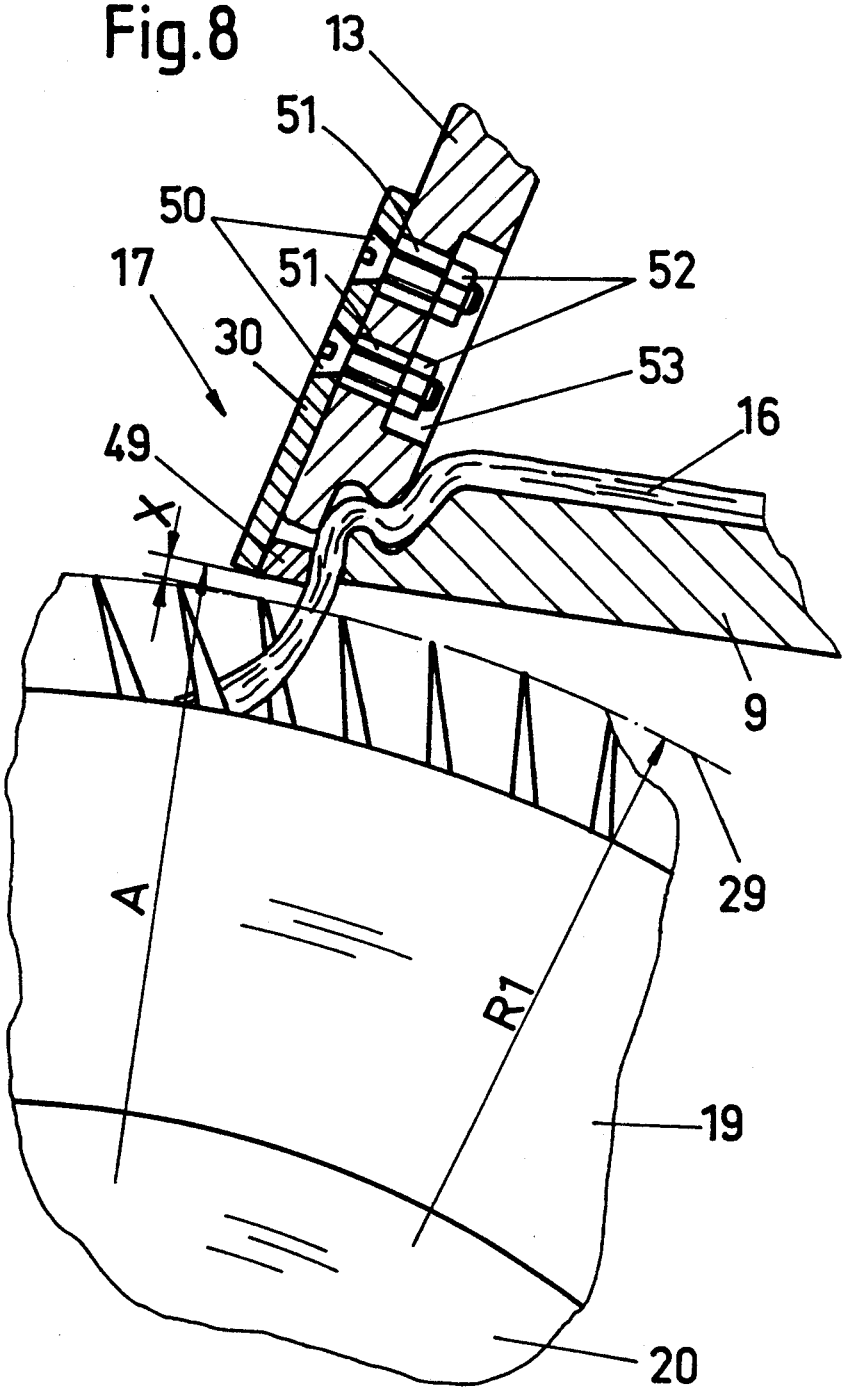
FIG. 8 illustrates a view similar to view 7 of a modified nipper lip adjustably mounted on a top nipper plate in accordance with the invention.

Referring to FIG. 8, wherein like reference characters indicate like parts as above, the nipper lip plate 30 carries a lower part 49 and is secured by pairs of screws 50 to the top nipper plate 13 so that the lower part 49 can be moved up or down, as viewed, relative to the top nipper plate 13. As indicated, each screw 50 passes through an enlarged opening 51 in the nipper plate 13 and is held in place by a nut 52 threaded onto the screw 50. As indicated, the nuts 52 are located in a recess 53 in the back of the top nipper plate 13.

The embodiments shown in FIGS. 7 and 8 have the advantage that the nipper lip, on the one hand, can be set precisely over the whole of the clamping line and, on the other hand, can be easily exchanged in the event of wear.

The invention thus provides a combing machine which can be universally adapted for processing thick or thin waddings. Further, the invention provides a combing machine with a nipper lip which can project towards the combing needles of a combing segment without risk of projecting into the working space of the needles.

What is claimed is:

1. A combing machine comprising a circular comb rotatably mounted on a axis of rotation and having a combing segment thereon with a plurality of projecting combing elements extending within an imaginary cylinder having a constant radius from said axis;

a nipper jaw unit for holding a leading end of a wadding in place for combing by said combing elements, said nipper jaw unit having a lower nipper, a top nipper for moving relative to said lower nipper between an open position spaced from said lower nipper and a closed position in contact with said lower nipper, and a nipper lip on said top nipper disposed in overlapping relation with said lower nipper with said top nipper in said closed position, said nipper lip being spaced from said axis of rotation of said comb a distance less than said radius of said imaginary cylinder in said closed position; and means for limiting movement of said top nipper towards said closed position on said lower nipper to provide a safety clearance between said nipper lip and said imaginary cylinder, said means including at least one spacer segment secured to said comb segment and projecting radially through said imaginary cylinder.

2. A combing machine as set forth in claim 1 wherein said segment is made of non-metallic material.

3. A combing machine as set forth in claim 2 wherein said nipper lip is laterally spaced from a front surface of said lower nipper to direct a leading edge of a wadding clamped therebetween radially of and is to said combing elements of said combing segment.

4. A combing machine as set forth in claim 1 wherein said nipper lip is adjustably mounted on said top nipper relative to said lower nipper.

5. A combing machine as set forth in claim 4 wherein said nipper lip is a plate adjustably mounted on said top nipper.

6. A combing machine as set forth in claim 4 wherein said nipper lip includes a movable part thereon for movement relative to said lower nipper.

* * * * *

UNITED STATES PATENT AND TRADEMARK OFFICE

CERTIFICATE OF CORRECTION

PATENT NO. : 5,255,416

DATED : Oct. 26, 1993

INVENTOR(S) : Hans-Ulrich Eichenberger, et al

It is certified that error appears in the above-identified patent and that said Letters Patent is hereby corrected as shown below:

Column 1, line 22 "Wadding" should be -wadding-

Line 28, "With" should be -with-

Column 5, line 41 "Wadding" should be -wadding-

Column 8, line 20 "is to" should be -into-

Signed and Sealed this

Fifth Day of April, 1994

Bruce Lehman

*Attest:*

BRUCE LEHMAN

*Attesting Officer*

*Commissioner of Patents and Trademarks*